US008646144B2

(12) United States Patent
Wada et al.

(10) Patent No.: US 8,646,144 B2
(45) Date of Patent: Feb. 11, 2014

(54) CLEANING SHEET

(75) Inventors: Minoru Wada, Tochigi (JP); Hiroshi Otsuka, Tochigi (JP)

(73) Assignee: Kao Corporation, Tokyo (JP)

( * ) Notice: Subject to any disclaimer, the term of this patent is extended or adjusted under 35 U.S.C. 154(b) by 1039 days.

(21) Appl. No.: 12/597,436

(22) PCT Filed: Apr. 25, 2008

(86) PCT No.: PCT/JP2008/058100

§ 371 (c)(1),
(2), (4) Date: Nov. 13, 2009

(87) PCT Pub. No.: WO2008/136424

PCT Pub. Date: Nov. 13, 2008

(65) Prior Publication Data

US 2010/0088837 A1 Apr. 15, 2010

(30) Foreign Application Priority Data

Apr. 27, 2007 (JP) ..... 2007-118092

(51) Int. Cl.
*A47L 13/16* (2006.01)

(52) U.S. Cl.
USPC ..... 15/208; 15/209.1

(58) Field of Classification Search
USPC ..... 15/208, 209.1, 210.1, 228; D32/40
See application file for complete search history.

(56) References Cited

U.S. PATENT DOCUMENTS 6,143,393 A 11/2000 Abe et al.
6,241,835 B1 6/2001 Abe et al.
6,245,413 B1 6/2001 Kenmochi et al.
6,329,308 B1 12/2001 Kenmochi et al.
6,813,801 B2 11/2004 Tanaka et al.
6,830,801 B1 12/2004 Kenmochi et al.
7,566,671 B2 * 7/2009 Hoadley et al. ..... 442/381
2004/0016074 A1 1/2004 Tanaka
2005/0092421 A1 5/2005 Kenmochi et al.
2006/0185108 A1 8/2006 Hoadley et al.
2007/0050934 A1 3/2007 Yamada (Continued)

FOREIGN PATENT DOCUMENTS

EP 0777997 A2 6/1997
EP 0 943 425 A1 9/1999

(Continued)

OTHER PUBLICATIONS

Computer generated English translation, JP 2001-286424, Hashimoto, Oct. 2001.*

(Continued)

*Primary Examiner* — Laura C Guidotti
(74) *Attorney, Agent, or Firm* — Birch, Stewart, Kolasch & Birch, LLP

(57) ABSTRACT

A cleaning sheet (1) includes at least one continuous-filament aggregate (10) formed by aggregating and orienting a multitude of continuous filaments (11) substantially in one orientation direction. The continuous filaments (11) are joined by a single first joining line (12) extending continuously in a direction orthogonal to the orientation direction of the continuous filaments (11) and are joined by a plurality of second joining lines (13) extending in the orientation direction. In this way, the continuous filaments (11) in the continuous-filament aggregate (10) are kept in an aggregated state. Preferably, the second joining lines (13) are connected to the first joining line (12).

8 Claims, 10 Drawing Sheets

(56) References Cited

U.S. PATENT DOCUMENTS

| | | | |
|---|---|---|---|
| 2007/0190878 | A1 | 8/2007 | Willman et al. |
| 2010/0015383 | A1 | 1/2010 | Yamada |
| 2010/0088837 | A1 | 4/2010 | Wada et al. |

FOREIGN PATENT DOCUMENTS

| | | | | |
|---|---|---|---|---|
| EP | 1 212 972 | A2 | 6/2002 | |
| JP | 11-235301 | A | 8/1999 | |
| JP | 2000-93373 | A | 4/2000 | |
| JP | 2000-245670 | A | 9/2000 | |
| JP | 2000-296084 | A | 10/2000 | |
| JP | 2001-286424 | * | 10/2001 | ..... A47L 13/16 |
| JP | 3107183 | U | 1/2005 | |
| JP | 2005-40641 | A | 2/2005 | |
| JP | 2005-131422 | A1 | 5/2005 | |
| JP | 3668630 | B2 | 7/2005 | |
| JP | 2006-230536 | A | 9/2006 | |
| JP | 2007-44270 | A | 2/2007 | |
| JP | 2007-289341 | A | 11/2007 | |
| JP | D1317543 | | 12/2007 | |
| JP | 2009-6134 | A | 1/2009 | |
| JP | 2009-153910 | A | 7/2009 | |
| WO | 10-5163 | A | 1/1998 | |
| WO | WO 03/049589 | A1 | 6/2003 | |
| WO | WO 2005/099549 | A1 | 10/2005 | |
| WO | 1 731 076 | A1 | 12/2006 | |
| WO | 2008/099733 | A1 | 8/2008 | |
| WO | 2008-289867 | A | 12/2008 | |
| WO | WO 2010/092895 | A1 | 8/2010 | |

OTHER PUBLICATIONS

Extended European Search Report issued on Nov. 8, 2010 in corresponding European Patent Application No. 08 75 2134.

International Preliminary Report on Patentability for Application No. PCT/JP2009/057248, dated Nov. 30, 2010.

International Search Report for Application No. PCT/JP2009/057248, dated Jul. 28, 2009.

English translation of International Preliminary Report on Patentability (Form PCT/IB/338 and 373) and Written Opinion of the International Searching Authority (Form PCT/ISA/237) issued on Dec. 3, 2009 in PCT/JP2008/058100.

International Search Report, PCT/JP2008/058100, Jul. 22, 2008.

International Search Report, PCT/JP2010/051573, Mar. 9, 2010.

* cited by examiner

CLEANING SHEET

TECHNICAL FIELD

The present invention relates to a cleaning sheet including at least one continuous-filament aggregate formed by aggregating and orienting a multitude of continuous filaments substantially in one direction.

BACKGROUND ART

There are cleaning sheets that are used by being attached to a head of a cleaning tool which further includes a handle connected to the head. One type of such heretofore-known cleaning sheets is "a disposable wipe-off article including: a heat-sealable sheet; and a bundle of heat-sealable continuous filaments bonded to the sheet and extending in one direction, the continuous filaments being bonded to the sheet by a plurality of heat-seal lines extending in a direction crossing the continuous filaments and arranged intermittently with respect to the longitudinal direction of the continuous filaments." (See Patent Document 1 listed below.)

Specific embodiments of the wipe-off article disclosed in Patent Document 1 include: an example in which the heat-seal lines consist of a plurality of curved lines that are parallel to one another and that cross the continuous filaments substantially obliquely; an example in which the heat-seal lines consist of a plurality of parallel straight lines that obliquely cross the continuous filaments; and an example in which the heat-seal lines consist of straight lines that obliquely cross the continuous filaments and that cross one another, exhibiting a grid pattern as a whole.

The high degree of freedom of the continuous filaments in the cleaning sheet disclosed in Patent Document 1 achieves good dirt trapping capabilities. However, the high degree of freedom of the continuous filaments causes mutual tangling of the continuous filaments before trapping any dust; this mutual tangling extremely reduces the degree of freedom of the continuous filaments and may thus significantly deteriorate the dirt trapping capabilities. Further, the cleaning sheet disclosed in Patent Document 1 gives absolutely no consideration to prevention of tangling among the continuous filaments.

Patent Document 1: U.S. Pat. No. 6,329,308B1

DISCLOSURE OF THE INVENTION

The present invention provides a cleaning sheet including at least one continuous-filament aggregate. A plurality of continuous filaments are substantially oriented in one direction in the aggregate. The continuous filaments in the continuous-filament aggregate of the cleaning sheet are kept in an aggregated state by being joined by a single first joining line extending continuously in a direction orthogonal to the orientation direction of the continuous filaments and by being joined by a plurality of second joining lines extending in the orientation direction of the continuous filaments.

BEST MODE FOR CARRYING OUT THE INVENTION

The present invention relates to a cleaning sheet including at least one continuous-filament aggregate formed by aggregating and orienting a multitude of continuous filaments substantially in one orientation direction, wherein the continuous filaments are kept from tangling with one another and thus maintain a high degree of freedom, thereby allowing the cleaning sheet to achieve superior dirt trapping capabilities.

Figure 1:
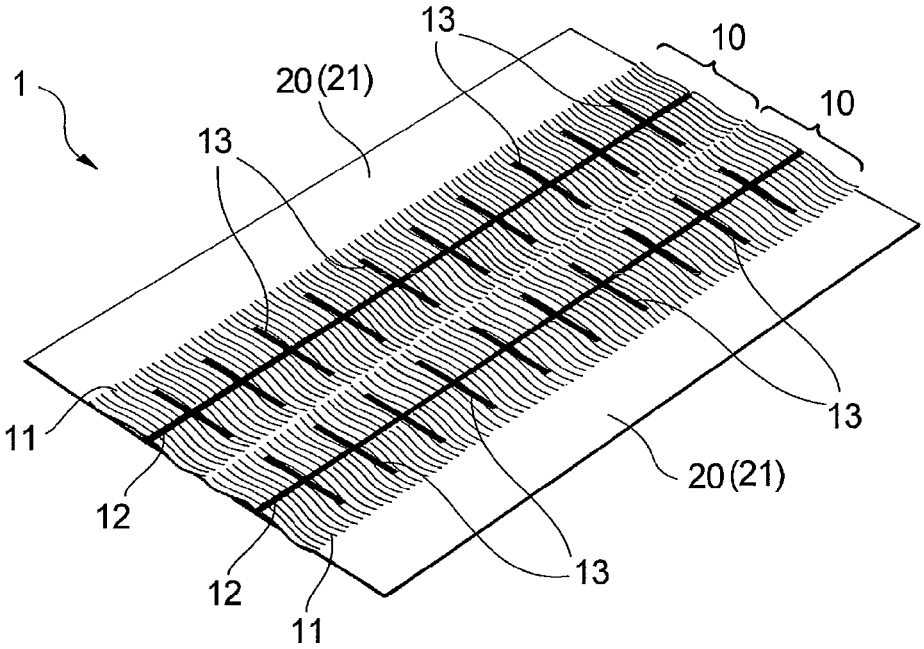
FIG. 1 is a perspective illustrating an embodiment of a cleaning sheet of the present invention.
Figure 2:
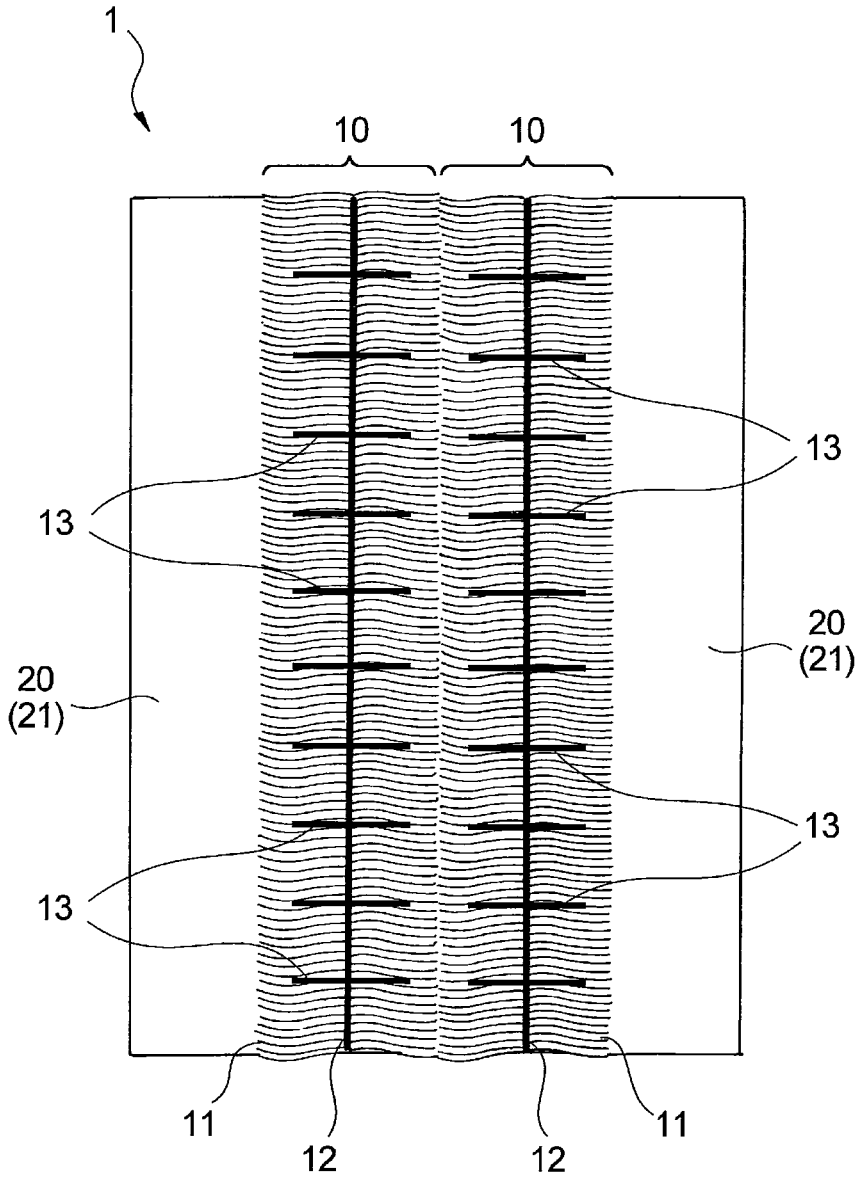
FIG. 2 is a plan view of the cleaning sheet illustrated in FIG. 1.
Figure 3:
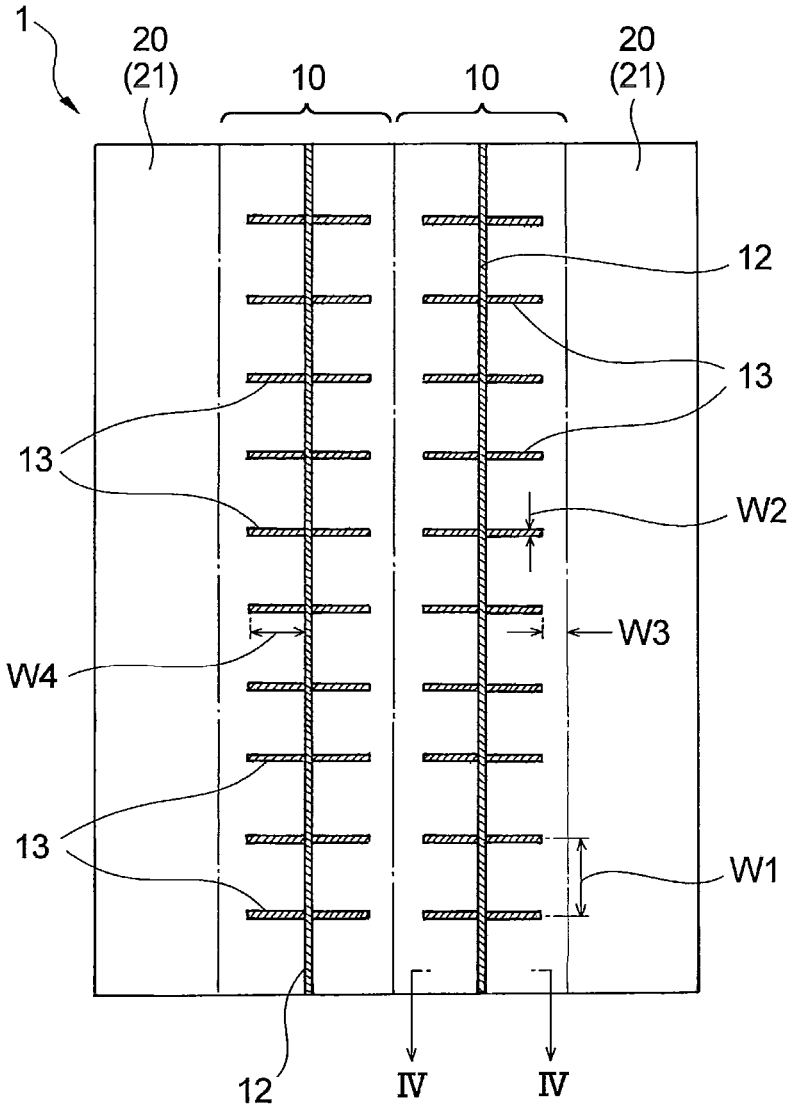
FIG. 3 is a plan view illustrating positions for forming joining lines in the cleaning sheet of FIG. 1.
Figure 4:
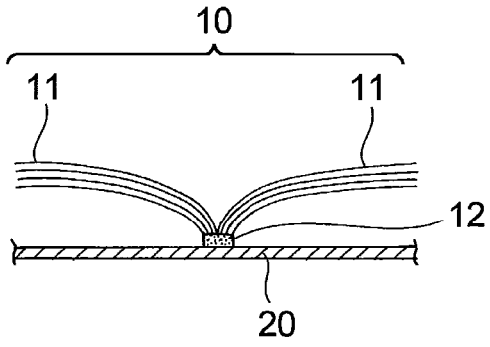
FIG. 4 is a cross-sectional view taken along line IV-IV illustrated in FIG. 3.

The following describes a cleaning sheet of the present invention according to preferred embodiments thereof with reference to the drawings. FIGS. 1 and 2 respectively illustrate a perspective and a plan view of an embodiment of a cleaning sheet of the present invention. FIG. 3 is a plan view illustrating positions for forming joining lines in the cleaning sheet of the embodiment illustrated in FIG. 1. Note that FIG. 3 virtually omits illustration of a continuous-filament aggregate 10 and instead illustrates its contour by alternate long-and-short dashed lines. FIG. 4 illustrates a cross-sectional view taken along line IV-IV of FIG. 3.

As illustrated in FIGS. 1 to 3, the cleaning sheet 1 of the present embodiment is a cleaning sheet including at least one continuous-filament aggregate 10 formed by aggregating and orienting a multitude of continuous filaments 11 substantially in one-orientation direction. Generally, the continuous filaments 11 are oriented in a direction in which the material therefor is carried during manufacturing. Note that the expression "the continuous filaments 11 are oriented substantially in one orientation direction" does not intend to exclude instances where the orientation direction of some of the continuous filaments 11 deviates from the orientation direction of the rest of the majority of the continuous filaments 11 due to manufacturing error, crimping of the continuous filaments 11, and so forth.

As illustrated in FIGS. 1 to 4, the continuous filaments 11 in the continuous-filament aggregate 10 are joined by a single first joining line 12 extending continuously in a direction orthogonal to the orientation direction of the continuous filaments 11 and are also joined by a plurality of second joining lines 13 extending in the orientation direction of the continuous filaments, which keeps the continuous filaments 11 in the continuous-filament aggregate 10 in their aggregated state. It will suffice if the first joining line 12, as viewed macroscopically, extends in the direction orthogonal to the orientation direction of the continuous filaments 11 and the second joining lines 13, as viewed macroscopically, extend in the orientation direction of the continuous filaments 11.

Viewed macroscopically from above, the continuous-filament aggregate 10 is rectangular in shape, and its lateral direction (the direction of the shorter sides) coincides with the orientation direction of the continuous filaments 11. In the present embodiment, the continuous-filament aggregate 10 is joined only to one side of a substrate sheet 20. Two continuous-filament aggregates 10 are provided side-by-side on one side of the substrate sheet 20, substantially without leaving a space therebetween.

The substrate sheet 20 is rectangular, and its longitudinal direction coincides with the longitudinal direction of the continuous-filament aggregate 10—i.e., its lateral direction coincides with the lateral direction of the continuous-filament aggregate 10. Note that in the following description, the term "longitudinal direction" refers to the longitudinal direction of the continuous-filament aggregate 10 or the substrate sheet 20 and the term "lateral direction" refers to the lateral direction of the continuous-filament aggregate 10 or the substrate sheet 20, unless expressly stated otherwise.

The continuous-filament aggregate 10 is formed by orienting a multitude of continuous filaments 11 so that they constitute a prescribed thickness. The continuous filaments 11 are oriented in the lateral direction of the substrate sheet 20. Accordingly, each continuous-filament aggregate 10 is joined to the substrate sheet 20 in such a design that the orientation direction of the continuous filaments 11 is orthogonal to the longitudinal direction of the substrate sheet 20.

In each continuous-filament aggregate 10, it is preferable to provide 5,000 to 50,000 pieces, and more preferably 10,000 to 40,000 pieces, of continuous filaments 11 per centimeter of the first joining line 12 on one side thereof.

The length of the continuous filament 11 is preferably 10 to 150 mm, and more preferably 30 to 120 mm, in view of dust trapping capabilities. The "length of the continuous filament 11" refers to the length from the first joining line 12 to the tip end of each continuous filament 11. In the present embodiment, continuous filaments 11 having such lengths are used in the form of a fiber bundle (tow). It is preferable to sufficiently open the fiber bundle with a known opening device beforehand. While the thickness of the continuous filaments 11 is not particularly critical, the thickness is preferably 0.1 to 200 dtex, and more preferably 2 to 30 dtex, to secure dust trapping capabilities and prevent scratches on the surface of an object-to-be-cleaned.

Crimped fibers may preferably be used for the continuous filaments 11 to further improve their dust trapping capabilities. Two-dimensionally or three-dimensionally crimped fibers can be used. The percentage of crimp (JIS L0208) is preferably 5 to 50%, and more preferably 10 to 30%, to obtain improved dust trapping capabilities. The percentage of crimp is defined as a percentage of a difference between the length A of a crimped fiber in its straightened state and the natural length B of the crimped fiber with respect to the length A, and is calculated from the following equation:

$$\text{Percentage of crimp } (\%) = (A-B)/A \times 100$$

The term "natural length B" refers to the length of a straight line connecting the two ends of a crimped fiber in its natural state. The term "natural state" means a state of a crimped fiber hanging under its own weight with its one end fixed to a horizontal plate. The term "length A of a crimped fiber in its straightened state" means the length of a crimped fiber stretched out until no crimp remains under a minimum load.

Figure 5:
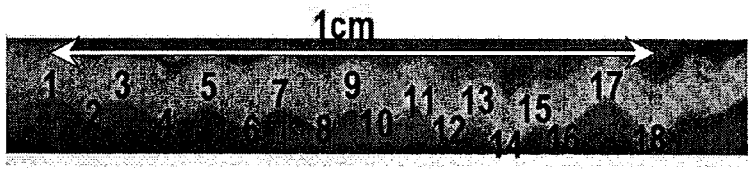
FIG. 5 is a photograph for explaining a method for measuring the number of crimps.

The continuous filament 11 may be crimped into a zigzag shape. For a zigzag-shaped continuous filament, the number of crimps (half of the total number of peaks and troughs) per centimeter is preferably 2 to 20, and more preferably 2 to 13. The number of crimps per centimeter is found by measuring the number of crimps according to JIS L1015 8.12.1 and then converting the number found to a per-centimeter value. For example, in the example illustrated in FIG. 5, there are a total of 18 peaks and troughs within the one-centimeter range indicated by the arrow, and therefore the number of crimps per centimeter is 9.

The height of crimp of a zigzag-shaped continuous filament (the difference in height between the alternating peaks and troughs of a crimped continuous filament 11) is preferably 0.1 to 5.0 mm, more preferably 0.1 to 2 mm, and even more preferably 0.1 to 0.7 mm. Setting the height of crimp within the above-mentioned range allows the continuous filaments 11 which constitute the continuous-filament aggregate 10 to assume a suitably opened state. This makes the shape of the spaces among the continuous filaments 11 suitable for trapping dirt so that soil can easily be trapped in the spaces among the continuous filaments 11, and also fluffs the continuous filaments 11 to provide a three-dimensional appearance thereto. Such a structure allows efficient cleaning not only of objects-to-be-cleaned having no space therein, but also objects-to-be-cleaned having narrow spaces or uneven contours. Further, it is possible to reduce the occurrence of aggregation caused by tangling of the filaments, which tends to occur after cleaning for a while, and to therefore use the cleaning sheet until the continuous-filament aggregate 10 becomes sufficiently soiled, without causing deterioration in trapping capabilities. An example of an "object-to-be-cleaned having narrow spaces" may be a doorstop and vicinities thereof. An example of an "object-to-be-cleaned having an uneven contour" may be a rail of a sill or a sliding door.

Figure 6:
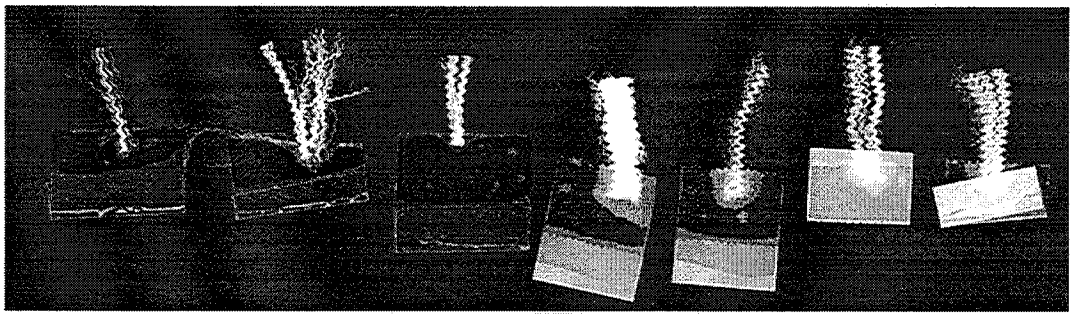
FIG. 6 is a photograph for explaining a method for measuring the height of crimp of a crimped fiber.

The height of crimp in the cleaning sheet 1 is measured as follows. Observing the continuous-filament aggregate 10, three or more sections that have the strongest (highest) crimps and that are not adjacent to one another are located. Then, an assembly of continuous filaments 11 (and not just a single continuous filament 11) having substantially the same curved form is located in each of the sections, and each assembly is cut out so as not to break its form. A cardboard or the like is laid down and fixed in a horizontal state, and the cut-out continuous filaments 11 are fixed at one longitudinal end thereof to the cardboard with a transparent tape in such a manner as not to place any load on the filaments other than their own weights and not to warp the cardboard etc. (see FIG. 6). In cases where the continuous filaments 11 include two-dimensional or three-dimensional crimps, the continuous filaments 11 are fixed so that the difference in the peaks and troughs thereof appears most significantly. The continuous filaments 11 are photographed in a linear-as-possible state without the filaments rising up from the cardboard etc. A scale or the like is taken in the same photograph to allow confirmation of the actual size.

Figure 7:
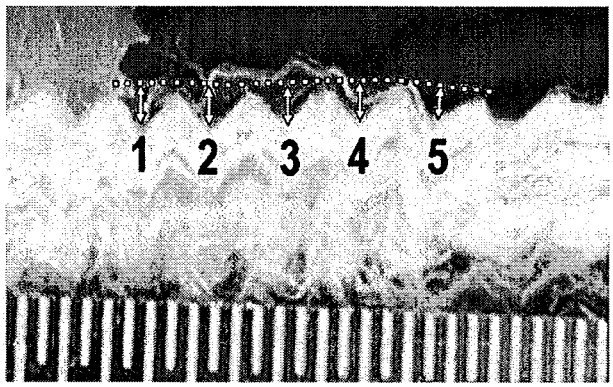
FIG. 7 is a photograph for explaining a method for measuring the height of crimp of a crimped fiber.

The photograph is enlarged, preferably four or more times, with a device allowing enlargement such as a copier or a scanner, so that the continuous filaments 11 are clearly visible (see FIG. 7). Of the enlarged continuous filaments 11, a linear-as-possible section having good crimping regularity is selected, and the vertical direction is determined with reference to an area in which the continuous filaments 11 are less irregular or appear more clearly. Then, the vertices of the adjacent troughs are connected, while paying attention to the inner and outer sides of the assembly of continuous filaments 11.

Then, as illustrated in FIG. 7, the substantially-perpendicular distance from each of the five consecutive peaks to the above-mentioned line connecting the adjacent troughs is measured. Here, the actual dimension is measured and determined for each of the five peaks while paying attention to magnification etc., and the average thereof is taken as the measurement value for this certain section (assembly). The other sections cut out from the same sample are measured in the same way. The three largest measurement values of all of the sections (assemblies) in the sample are averaged, and this average is taken as the height of crimp of that certain sample.

In some cases, the height of crimp of the continuous filaments 11 may differ among the various sections of the continuous-filament aggregate 10. In the cleaning sheet of the present invention, the height of crimp of the continuous filaments 11 is obtained by measuring sections that are considered to have the largest degree of crimps within the continuous-filament aggregate 10, and can therefore be regarded as defining the maximum value of the various heights of crimp of the continuous filaments 11.

Colors other than white (such as orange or light blue) may be used for the continuous filaments 11 in order, for example, to improve the product appearance and visibility of any soil attached.

The length of the substrate sheet 20 is substantially the same as that of the continuous-filament aggregate 10. The width of the substrate sheet 20 is wider than the total width of two continuous-filament aggregates 10. The regions of the substrate sheet 20 located laterally outward of the continuous-filament aggregates 10 (which are referred to hereinafter as "flaps 21") are used to attach the cleaning sheet to a head 31 of a cleaning tool 30 (described in detail further below).

The substrate sheet 20 is flexible in its longitudinal direction, and thus easily conforms to the contour of an object-being-cleaned. Accordingly, the continuous-filament aggregates 10 joined to the substrate sheet 20 are conformable to the contour of an object-to-be-cleaned, providing the cleaning sheet 1 with a superior dirt-and-dust trapping effect. Fibrous sheets such as nonwoven fabrics used for conventional cleaning sheets may be used as the material for forming the substrate sheet 20. Air-through nonwoven fabrics or spunbonded nonwoven fabrics are particularly preferable. Further, nonwoven fabrics, netted sheets, films, synthetic paper, or composite materials made thereof may be used as the material for forming the substrate sheet 20.

The first joining line 12 extends continuously in a direction orthogonal to the orientation direction of the continuous filaments 11, and only a single first joining line 12 is provided for each continuous-filament aggregate 10. The second joining lines 13 extend in the orientation direction of the continuous filaments 11, and a plurality of second joining lines 13 are provided for each continuous-filament aggregate 10. The number of second joining lines 13 per continuous-filament aggregate 10 is preferably 3 to 15, and more preferably 5 to 12. Note that in cases where the second joining lines 13 are connected across the first joining line 12 at the same longitudinal position, the number of second joining lines 13 is counted as "two".

The first joining line 12 is continuous and straight-linear, and spans the entire longitudinal region of the continuous-filament aggregate 10 in the laterally-central portion thereof. The width of the first joining line 12 is preferably 2 to 15 mm, and more preferably 2 to 5 mm. Each second joining line 13 is continuous and straight-linear, and its inner end is connected to the first joining line 12. The second joining lines 13 are provided in pairs on both sides of the first joining line 12 at prescribed positions; accordingly, a plurality of pairs of second joining lines 13, 13 are provided along the longitudinal direction. Figuratively, the first joining line 12 and the second joining lines 13 are arranged like fish-bones.

The distance W1 (see FIG. 3) between adjacent second joining lines 13 in the direction orthogonal to the orientation direction of the continuous filaments 11 is preferably 5 to 70 mm, and more preferably 10 to 50 mm. This distance W1 is measured using the widthwise center of each second joining line 13 as a reference. The width W2 of each second joining line 13 (see FIG. 3) is preferably 2 to 15 mm, and more preferably 2 to 10 mm.

The second joining lines 13 do not extend up to the tip ends of the continuous filaments 11 in the continuous-filament aggregate 10, but are set back in the laterally-inward direction from the tip ends of the continuous filaments 11. Accordingly, the tip ends and vicinities thereof of the continuous filaments 11 in the continuous-filament aggregate 10 are not joined by the second joining lines 13. The distance W3 (see FIG. 3) between the tip end of the continuous filament 11 in the continuous-filament aggregate 10 and the outer end of the second joining line 13 is preferably 3 to 50 mm, and more preferably 10 to 40 mm.

The first joining line 12 and the second joining lines 13 are formed of known joining means such as heat-sealing or adhesion with a hot-melt adhesive. The first joining line 12 and the second joining lines 13 may be formed of different joining means. The first joining line 12, as well as each second joining line 13, may be formed by combining a plurality of joining means. For example, the first joining line 12 and each second joining line 13 may be formed of a two-layered joining line having a heat-sealing line (upper layer) and a hot-melt adhesive (lower layer).

The following describes in detail a method for forming a first joining line 12 and second joining lines 13 consisting of two-layered joining lines. First, in order to prevent the continuous filaments 11 from falling apart, a single heat-sealing line is applied, extending in the longitudinal direction of the continuous-filament aggregate 10 (the direction orthogonal to the orientation direction of the continuous filaments 11), to the laterally central portion of the continuous-filament aggregate 10, and also, a plurality of heat-sealing lines are applied extending in the lateral direction (the orientation direction of the continuous filaments 11). The heat-sealing line extending in the longitudinal direction of the continuous-filament aggregate 10 and the heat-sealing lines extending in the lateral direction thereof result in the continuous filaments 11 being kept in an aggregated state, even when the continuous-filament aggregate 10 is not joined to the substrate sheet 20.

Then, two continuous-filament aggregates 10, 10 are provided side-by-side on one side of the substrate sheet 20, substantially without leaving a space therebetween, and are joined to the substrate sheet 20 with a hot-melt adhesive. The hot-melt adhesive is applied on positions matching the heat-sealing lines, as viewed from above. The above joining process achieves a first joining line 12 and second joining lines 13 having a two-layered structure consisting of a heat-sealing line (upper layer) and a hot-melt adhesive (lower layer).

Figure 8:
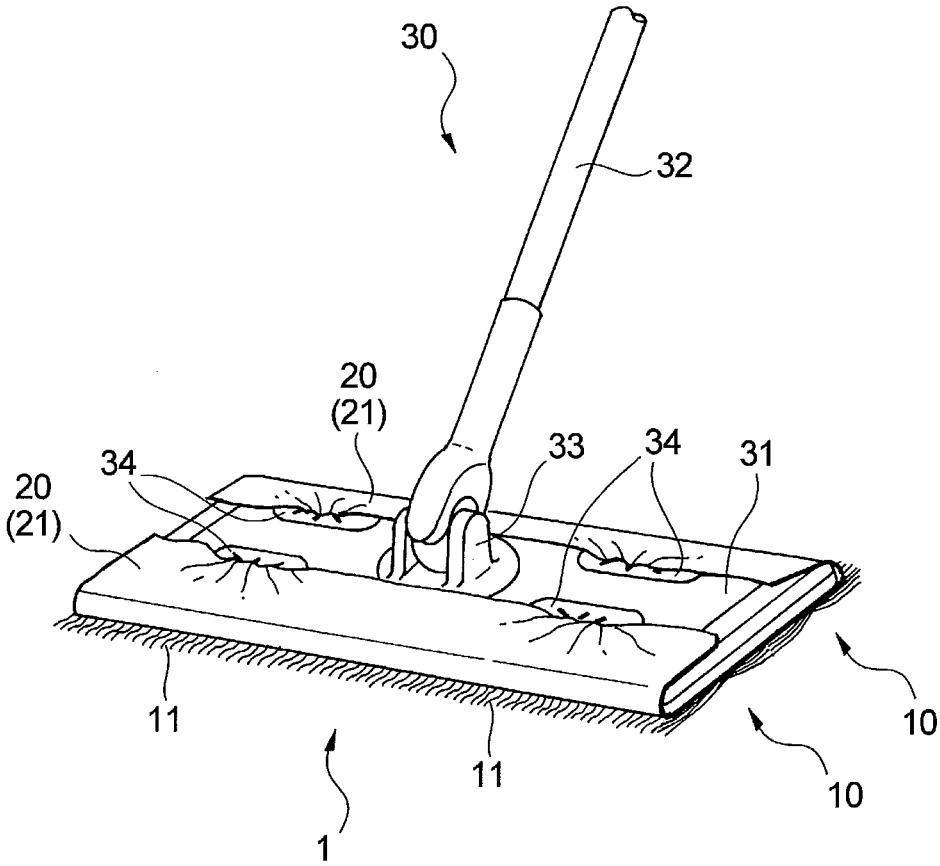
FIG. 8 is a perspective illustrating how the cleaning sheet of FIG. 1 is attached to a head of a cleaning tool.

As illustrated in FIG. 8, the cleaning sheet 1 of the present embodiment is used on a cleaning tool 30 that has a head 31 and a handle 32 connected to the head 31, with the substrate sheet 20 being utilized to attach the cleaning sheet 1 to the head 31. The cleaning tool 30 illustrated in FIG. 8 includes a head 31 to which the cleaning sheet 1 of the present embodiment can be attached, and a rod-like handle 32 connected to the head 31 via a universal joint 33. The attachment surface (bottom surface) of the head 31 is rectangular as viewed from above. Normally, the cleaning tool 30 is used to perform cleaning by moving (particularly back and forth) the head 31 along its lateral direction (the direction of its shorter sides). In other words, the cleaning direction of the cleaning tool 30 is in the lateral direction of the head 31.

The cleaning sheet 1 is attached to the head 31 so that the side of the substrate sheet 20 without the continuous-filament aggregates 10 faces the attachment surface (bottom surface) of the head 31. Then, the flaps 21, 21 of the substrate sheet 20 are folded back toward the upper surface of the head 31. The flaps 21 are then pressed into a plurality of flexible sheet retainers 34 provided in the head 31, each having slits in a radial pattern. In this way, the cleaning sheet 1 can be fixed to the head 31 of the cleaning tool 30. Note that forming the substrate sheet 20 out of a netted sheet is preferable because of the good engagement between the substrate sheet 20 and the sheet retainers 34. The cleaning sheet 1 of the present embodiment can be used in this state for sweeping wooden floors, for example. Accordingly, the continuous filaments 11 in the continuous-filament aggregate 10 are oriented substantially in the cleaning direction of the cleaning tool 30.

Further, the width of the head 31 is shorter than the total width of the continuous-filament aggregates 10 on the cleaning sheet 1. Therefore, when focusing on the opposite ends, in the cleaning direction, of the continuous-filament aggregates 10 in a state where the cleaning sheet 1 is attached to the head 31 of the cleaning tool 30 utilizing the substrate sheet 20, the outer end sections of the continuous-filament aggregates 10 in the cleaning direction (i.e., the tip ends of the continuous filaments 11) are located outward from the head 31, as illustrated in FIG. 8. Note that the attachment surface of the head 31 may be flat or may be curved projecting downward. Further, the way in which the substrate sheet 20 is fixed to the head 31 is not limited to the above configuration using the flaps 21 and the sheet retainers 34.

When attached to the head 31 of a cleaning tool 30, the cleaning sheet 1 of the present embodiment can be used for cleaning, such as sweeping (mopping) wooden-floored rooms, in the same way as ordinary mopping tools. The continuous filaments 11 are joined by a single first joining line 12 extending continuously in the direction orthogonal to the orientation direction of the continuous filaments 11 and are also joined by a plurality of second joining lines 13 extending in the orientation direction, and this restricts movement of the continuous filaments. This restriction of movement of the continuous filaments suppresses the continuous filaments 11 in the continuous-filament aggregate 10 from tangling with one another, thus maintaining a high degree of freedom of the continuous filaments 11. Accordingly, the cleaning sheet 1 exhibits good dirt trapping capabilities, and this good trapping ability is maintained.

Further, the tip ends and vicinities thereof of the continuous filaments 11 in the continuous-filament aggregate 10 are not joined by the second joining lines 13. Therefore, the tip ends and vicinities thereof of the continuous filaments 11 serve effectively to trap dirt.

Figure 9:
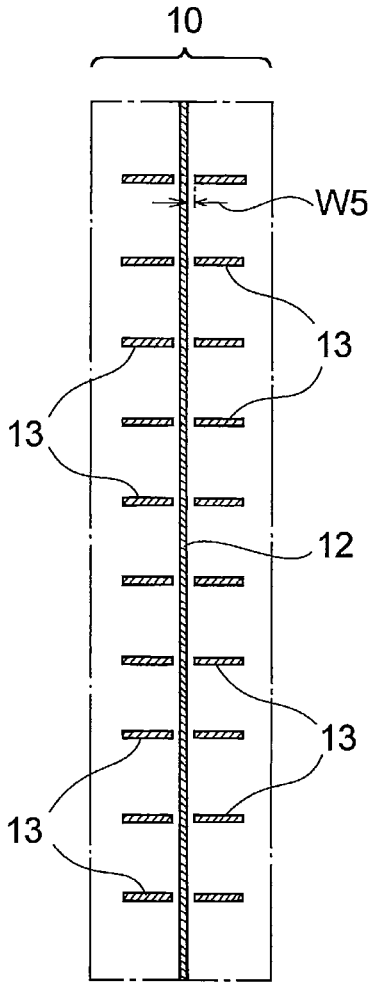
FIG. 9 is a plan view of a first modified example regarding positions for forming joining lines in a continuous-filament aggregate.
Figure 10:
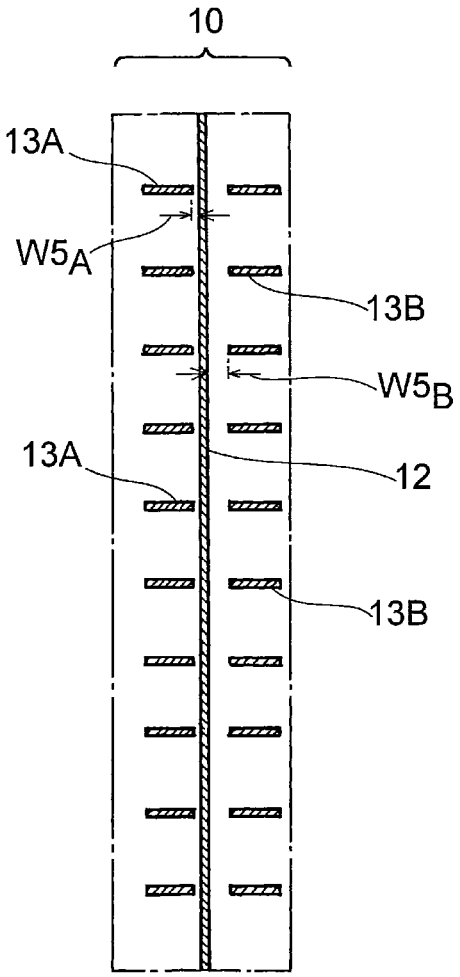
FIG. 10 is a plan view illustrating a modified example of the embodiment of FIG. 9.

The cleaning sheet of the present invention is not limited to the foregoing embodiment and can be modified as appropriate without departing from the gist of the invention. For example, as illustrated in FIG. 9, the inner ends of the second joining lines 13 in the continuous-filament aggregate 10 do not have to be connected to the first joining line 12 and may be spaced therefrom. In this case, the distance W5 between the second joining line 13 and the first joining line 12 is preferably 1 to 20 mm, and more preferably 5 to 10 mm. Further, as illustrated in FIG. 10 which is a modified example of the embodiment illustrated in FIG. 9, the distance $W5_A$ between the first joining line 12 and a second joining line 13A located on one side of the first joining line 12 may be different from the distance $W5_B$ between the first joining line 12 and a second joining line 13B located on the other side of the first joining line 12. More specifically, $W5_B$ may be longer than $W5_A$. Making the distance longer increases the degree of freedom of the continuous filaments 11, allowing dirt of relatively large size to be trapped. Making the distance shorter decreases the degree of freedom of the continuous filaments 11, which reduces mutual tangling of the continuous filaments 11 and thus improves dirt trapping capabilities. Combining these two aspects improves the comprehensive dirt trapping capabilities. The respective values of $W5_A$ and $W5_B$ can be adjusted as appropriate within the range given for W5 above.

Figure 11:
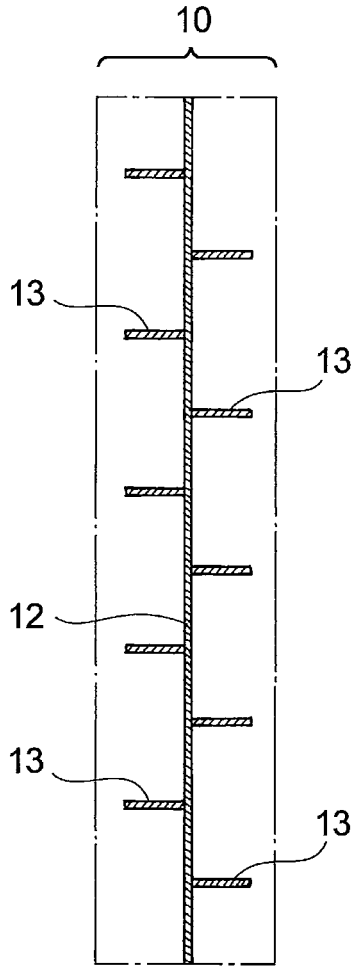
FIG. 11 is a plan view of a second modified example regarding positions for forming joining lines in a continuous-filament aggregate.

Further, as illustrated in FIG. 11, the second joining lines 13 in the continuous-filament aggregate 10 may be provided in a staggered arrangement with respect to the first joining line 12.

The outer ends of the second joining lines 13 may extend up to the outer end sections of the continuous-filament aggregate 10 in the cleaning direction (i.e., to the tip ends of the continuous filaments 11).

Figure 12:
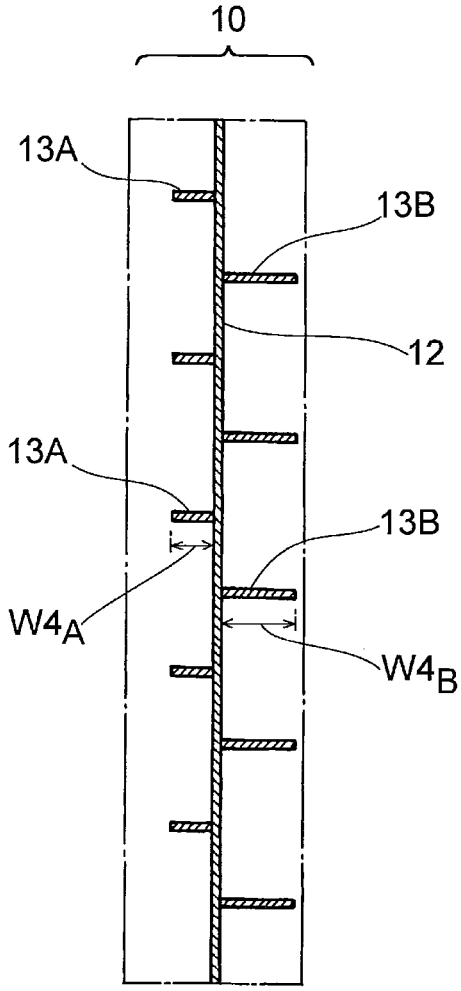
FIG. 12 is a plan view illustrating a modified example of the embodiment of FIG. 11.

As illustrated in FIG. 12 which is a modified example of the embodiment illustrated in FIG. 11, the second joining lines 13A located on one side of the first joining line 12 and the second joining lines 13B located on the other side of the first joining line 12 may be staggered, and the length $W4_A$ of the second joining lines 13A may be made different from the length $W4_B$ of the second joining lines 13B. Making the length shorter increases the degree of freedom of the continuous filaments 11, allowing dirt of relatively large size to be trapped. Making the length longer decreases the degree of freedom of the continuous filaments 11, which reduces mutual tangling of the continuous filaments 11 and thus improves dirt trapping capabilities. Combining these two aspects improves the comprehensive dirt trapping capabilities.

In view of the above, the arrangement of the first joining line 12 and the second joining lines 13A and 13B may be a combination of FIGS. 10 and 12.

Figure 13:
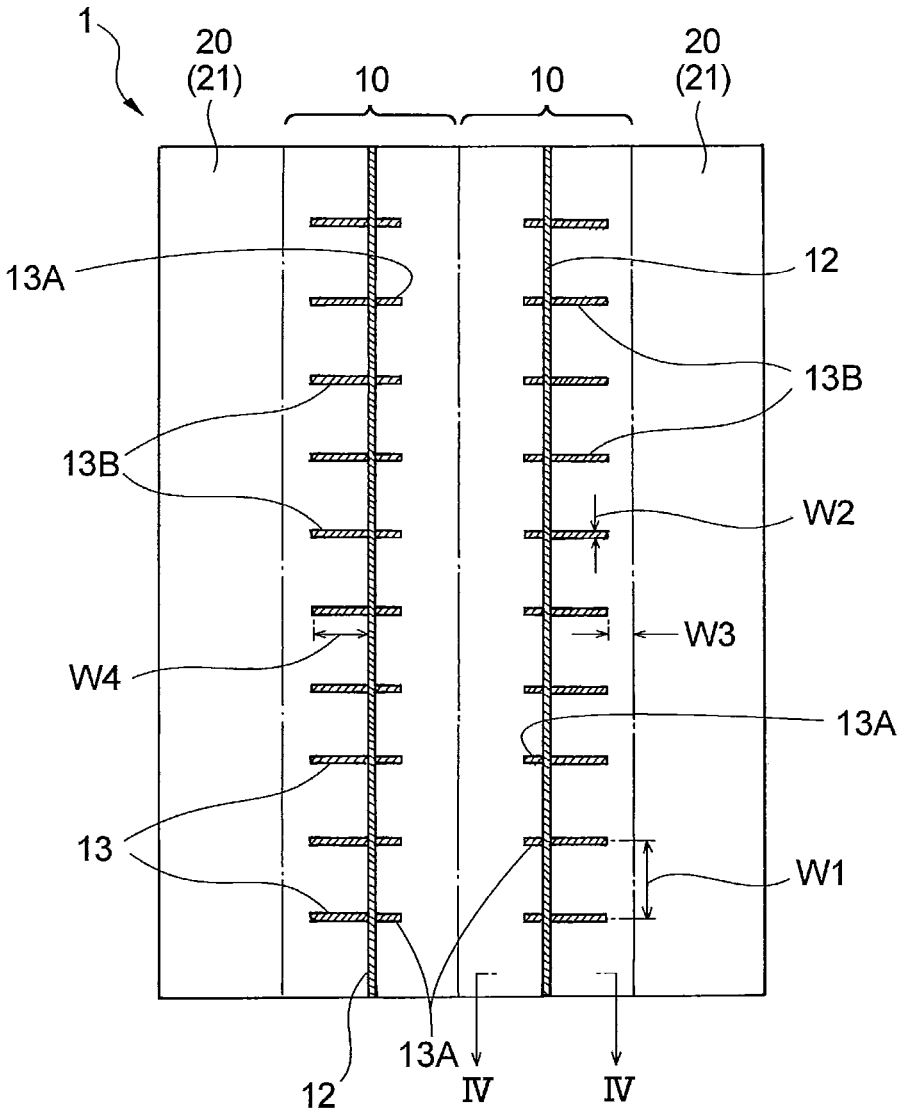
FIG. 13 is a plan view (corresponding to FIG. 3) illustrating a modified example of the embodiment illustrated in FIGS. 1 to 4.

Further, as illustrated in FIG. 13 which is a modified example of the embodiment illustrated in FIGS. 1 to 4, two continuous-filament aggregates 10 may be arranged side-by-side, and in this state, the length of the second joining lines 13A located on the inner side of the first joining line 12 in each continuous-filament aggregate 10 may be made different from the length of the second joining lines 13B located on the outer side of the first joining line 12. In this case, the second joining lines 13B may be made longer than the second joining lines 13A as illustrated in the figure, or vice versa.

The plurality of continuous-filament aggregates 10 may be arranged spaced apart from one another in the lateral direction of the substrate sheet 20. Only one continuous-filament aggregate 10, or three or more continuous-filament aggregates 10, may be provided on one side of the substrate sheet 20. The continuous-filament aggregates 10 may be provided on both sides of the substrate sheet 20.

Further, the cleaning sheet of the present invention does not have to include a substrate sheet 20, and may consist only of the continuous-filament aggregate 10. In this case, the continuous filaments 11 in the continuous-filament aggregate 10 need to be kept in an aggregated state by the first joining line 12 and the second joining lines 13, without the substrate sheet 20.

The first joining line 12 may be provided in a position deviating from the laterally central portion of the continuous-filament aggregate 10.

The above-described configurations of the cleaning sheet 1 may be combined as appropriate.

Figure 14:
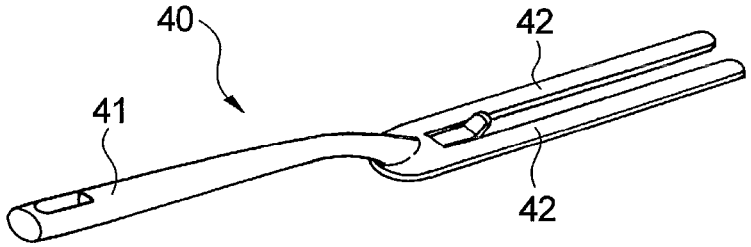
FIG. 14 is a perspective illustrating a holder to which a cleaning sheet of the present invention may be attached.

The cleaning sheet of the present invention may be used attached to a holder 40 as illustrated in FIG. 14. The holder 40 of FIG. 14 includes a handle 41, and a pair of insertion portions 42, 42 forked from the tip end of the handle 41. Preferably, a cleaning sheet to be attached to such a holder 40 has a substrate sheet provided with holder-receiving pockets (not shown) into which the insertion portions 42 are inserted for fixing the holder 40 to the sheet. Such a cleaning sheet can be used for cleaning furniture, household electrical appliances, etc., by holding the holder 40 with the cleaning sheet attached thereto.

EXAMPLES

The present invention is described in further detail below according to Examples thereof. The scope of the invention, however, is not to be limited by these Examples.

Example 1

A cleaning sheet as illustrated in FIGS. 1 to 3 was produced. A sheath/core-type heat fusible conjugate fiber having a thickness of 2.2 dtex and employing polyethylene terephthalate as the core and polyethylene as the sheath was used for the continuous filaments 11 constituting the continuous-filament aggregates 10. Three grams of a fiber bundle (tow) of the conjugate fiber was opened with an opening device to a dimension 280 mm long and 80 mm wide. Note that the lateral direction of the continuous-filament aggregate 10 matches the orientation direction of the continuous filaments 11. In order to prevent the continuous filaments 11 from falling apart, a single heat-sealing line (which becomes the upper layer of the first joining line 12) is applied extending in the longitudinal direction of the continuous-filament aggregate 10 (the direction orthogonal to the orientation direction of the continuous filaments 11) to the laterally central portion of the continuous-filament aggregate 10, and also, a plurality of heat-sealing lines (which become the upper layers of the second joining lines 13) are applied extending in the lateral direction (the orientation direction of the continuous filaments 11). The heat-sealing line extending in the longitudinal direction of the continuous-filament aggregate 10 and the heat-sealing lines extending in the lateral direction thereof allow the continuous filaments 11 to be kept in an aggregated state, even when the continuous-filament aggregate 10 is not joined to a substrate sheet 20.

An air-through nonwoven fabric having a basis weight of 40 g/m$^2$ was used for the substrate sheet 20. The constituent fiber was a sheath/core-type heat fusible conjugate fiber (2.2 dtex×51 mm) employing polyethylene terephthalate as the core and polyethylene as the sheath. The substrate sheet 20 was 285 mm long and 205 mm wide.

Two of the continuous-filament aggregates 10, 10 were provided side-by-side on one side of the substrate sheet 20, substantially without leaving a space therebetween, and were joined to the substrate sheet 20 with a hot-melt adhesive. The hot-melt adhesive was applied on positions matching the heat-sealing lines, as viewed from above. Accordingly, the first joining line 12 had a two-layered structure consisting of a heat-sealing line (upper layer) and a hot-melt adhesive (lower layer) extending in the longitudinal direction of the continuous-filament aggregate 10, and the second joining lines 13 each had a two-layered structure consisting of a heat-sealing line (upper layer) and a hot-melt adhesive (lower layer) extending in the lateral direction of the continuous-filament aggregate 10.

A single first joining line 12 extends across the entire longitudinal length in the laterally central position of the continuous-filament aggregate 10. The first joining line 12 was 5 mm wide. As illustrated in FIG. 3, a plurality of the second joining lines 13 are provided extending in the lateral direction of the continuous-filament aggregate 10, and their inner ends are connected to the first joining line 12, whereas their outer ends are set back in the laterally-inward direction from the tip ends of the continuous filaments 11 in the continuous-filament aggregate 10. The length W4 of each second joining line 13 (see FIG. 3) was 27.5 mm, and the distance W3 between the outer end of each second joining line 13 and the tip ends of the continuous filaments 11 (see FIG. 3) was 10 mm. The distance W1 between adjacent second joining lines 13 (see FIG. 3) was 30 mm, and the width W2 of each second joining line 13 (see FIG. 3) was 5 mm. There were ten second joining lines 13 on each side of the first joining line 12 (i.e., a total of twenty on both sides).

Examples 2 to 9

In Examples 2 to 9, the distance W1 between the second joining lines 13, the width W2 thereof, and the number of lines (on one side) were changed from those in Example 1 to the values shown in Table 1 below. The other aspects were the same as those in Example 1.

Comparative Example 1

Different from Example 1, Comparative Example 1 had no second joining line 13 (although it had a first joining line 12). The other aspects were the same as those in Example 1.

Comparative Example 2

Different from Comparative Example 1, Comparative Example 2 had two first joining lines 12 arranged side-by-side (but no second joining line 13). The distance in the lateral direction between the two first joining lines 12 (the center-to-center distance) was 20 mm. The other aspects were the same as those in Example 1.

Dirt Trapping Capabilities

Cleaning sheets 1 according to the Examples and the Comparative Examples were respectively attached to a cleaning tool 30 as illustrated in FIG. 8. The tool was used to sweep an eight-tatami-mat-sized wooden-floored room (having a size equal to eight tatami mats, each mat being approximately 182 cm long and 91 cm wide), scattered with strands of hair and lint. The dirt trapping capabilities of each cleaning sheet were evaluated. The evaluation criteria were as follows:

A: All of the dirt was completely trapped.

B: Dirt slightly remained, but most of the dirt was trapped.

C: Some of the dirt could not be trapped and thus remained.

F: About half of the dirt could not be trapped and thus remained.

Degree of Tangling Among Continuous Filaments

After performing sweeping according to the procedures given in "Dirt Trapping Capabilities" above, the degree of tangling among the continuous filaments 11 in the continuous-filament aggregates 10 of each cleaning sheet 1 was evaluated. The evaluation criteria were as follows:

A: There was absolutely no tangling among the continuous filaments.

B: A slight amount of tangling was observed among the continuous filaments.

C: Tangling among the continuous filaments was observed in around 10% to 30% of the entire area.

F: Tangling among the continuous filaments was observed in more than 30% of the entire area.

The evaluation results for the Examples and the Comparative Examples are as shown in Table 1 below.

TABLE 1

| | Distance Between Second Joining Lines (mm) | Width of Second Joining Line (mm) | Number of Second Joining Lines | Dirt Trapping Capabilities | Degree of Tangling Among Continuous Filaments |
|---|---|---|---|---|---|
| Example 1 | 30 | 5 | 10 | A | A |
| Example 2 | 7 | 5 | 39 | B | A |
| Example 3 | 60 | 5 | 5 | A | B |
| Example 4 | 30 | 3 | 10 | A | B |
| Example 5 | 30 | 13 | 10 | B | A |
| Example 6 | 5 | 3 | 55 | C | A |
| Example 7 | 80 | 5 | 4 | B | C |
| Example 8 | 30 | 1 | 10 | A | C |
| Example 9 | 30 | 20 | 10 | C | A |
| Comparative Example 1 | — | — | 0 | B | F |
| Comparative Example 2 | — | — | 0 | F | A |

Note:
Comparative Example 1 has one first joining line.
Comparative Example 2 has two first joining lines.

As is clearly understood from the evaluation results shown in Table 1, it is confirmed that the Examples are able to suppress tangling among the continuous filaments. Further, it can be confirmed that in Comparative Example 1, the continuous filaments get tangled with one another. Also, it can be confirmed that Comparative Example 2 can suppress tangling among the continuous filaments, but has poor dirt trapping capabilities.

Industrial Applicability

As described in detail above, the cleaning sheet of the present invention keeps the continuous filaments from tangling with one another and can thus maintain a high degree of freedom of the continuous filaments, thereby achieving superior dirt trapping capabilities.

The invention claimed is:

1. A cleaning sheet comprising at least one continuous-filament aggregate in which a plurality of continuous filaments are substantially oriented in one orientation direction, wherein the continuous filaments in the continuous-filament aggregate are kept in an aggregated state by being joined by a single first joining line extending continuously in a direction orthogonal to the orientation direction of the continuous filaments;

wherein the continuous filaments in the continuous-filament aggregate are joined by a plurality of second joining lines that are continuous and straight-linear and extend parallel to the orientation direction of the continuous filaments; and wherein the second joining lines are connected to the first joining line.

2. The cleaning sheet according to claim 1, wherein the continuous-filament aggregate is joined to one side or both sides of a substrate sheet.

3. The cleaning sheet according to claim 2, wherein a plurality of the continuous-filament aggregates are provided on one side or both sides of the substrate sheet.

4. The cleaning sheet according to claim 1, wherein tip ends and vicinities thereof of the continuous filaments in the continuous-filament aggregate are not joined by the second joining lines.

5. The cleaning sheet according to claim 1, wherein a distance between the adjacent second joining lines is 5 to 70 mm in the direction orthogonal to the orientation direction of the continuous filaments.

6. The cleaning sheet according to claim 1, wherein a width of the second joining line is 2 to 15 mm.

7. A cleaning tool, comprising:

a head;

a handle connected to the head; and the cleaning sheet according to claim 2, wherein the substrate sheet is utilized to attach the cleaning sheet to the head of the cleaning tool.

8. The cleaning tool according to claim 7, wherein the width of the head is shorter than the total width of the continuous-filament aggregates on the cleaning sheet; and wherein tip ends of the continuous filaments are located outward from the head.

* * * * *